US011212632B2

(12) United States Patent
Deruty

(10) Patent No.: US 11,212,632 B2
(45) Date of Patent: Dec. 28, 2021

(54) AUDIO PROCESSING TO COMPENSATE FOR TIME OFFSETS

(71) Applicant: SONY EUROPE B.V., Weybridge (GB)

(72) Inventor: Emmanuel Deruty, Stuttgart (DE)

(73) Assignee: SONY EUROPE B.V., Surrey (GB)

( * ) Notice: Subject to any disclaimer, the term of this patent is extended or adjusted under 35 U.S.C. 154(b) by 51 days.

(21) Appl. No.: 16/636,028

(22) PCT Filed: Aug. 2, 2018

(86) PCT No.: PCT/EP2018/071048
§ 371 (c)(1),
(2) Date: Feb. 3, 2020

(87) PCT Pub. No.: WO2019/038051
PCT Pub. Date: Feb. 28, 2019

(65) Prior Publication Data

US 2021/0152967 A1 May 20, 2021

(30) Foreign Application Priority Data

Aug. 25, 2017 (EP) ..... 17187985

(51) Int. Cl.
*H04R 5/00* (2006.01)
*H04S 1/00* (2006.01)

(52) U.S. Cl.
CPC ..... *H04S 1/007* (2013.01); *H04S 2400/01* (2013.01)

(58) Field of Classification Search
CPC ..... H04R 5/00
See application file for complete search history.

(56) References Cited

U.S. PATENT DOCUMENTS 4,890,065 A 12/1989 Laletin
2017/0178639 A1* 6/2017 Atti ..... G10L 19/167

FOREIGN PATENT DOCUMENTS

WO 2002/084645 A2 10/2002

OTHER PUBLICATIONS

International Search Report and Written Opinion dated Sep. 13, 2018, for PCT/EP2018/071048 filed on Aug. 2, 2018, 11 pages.
(Continued)

*Primary Examiner* — Olisa Anwah
(74) *Attorney, Agent, or Firm* — Xsensus LLP

(57) ABSTRACT

A method of processing each of a first plurality of temporal windows of first and second input audio signals to generate first and second output audio signals comprises (a) detecting a time offset between respective portions of the first and second input audio signals corresponding to a given temporal window by: (i) detecting a correlation between one or more properties of the respective portions according to each of a group of candidate time offsets under test; and (ii) selecting, as a detected time offset for the given temporal window, an offset for which the detecting step (i) detects a correlation which meets a predetermined criterion such as greatest correlation; and (b) for each of a second plurality of temporal windows, generating a portion of the first and second output signals by applying a relative delay between portions of the first and second input audio signals in order to correct one or both of the input audio signals to generate a pair of output audio signals (such as a stereo pair) having a reduced temporal disparity between the audio content of the two signals.

21 Claims, 14 Drawing Sheets

(56) References Cited

OTHER PUBLICATIONS

Aichinge, P., et al., "Describing the transparency of mixdowns: The Masked-to-Unmasked-Ratio," Convention Paper 8344, Audio Engineering Society, London, UK, May 13-16, 2011, pp. 1-10.
Bitzer, J., and Leboeuf, J., "Automatic detection of salient frequencies," Convention Paper 7704, Audio Engineering Society, Munich, Germany, May 7-10, 2009, pp. 1-6.
Dannenberg, R.B., "An Intelligent Multi-Track Audio Editor," Proceedings of the 2007 International Computer Music Conference, vol. 2, Aug. 2007, pp. 1-7.
Deruty, E., and Tardieu, D., "About Dynamic Processing in Mainstream Music," J. Audio Eng. Soc., vol. 62, No. 1/2, Jan./Feb. 2014, pp. 42-55.
Deruty, E., et al., "Human-Made Rock Mixes Feature Tight Relations Between Spectrum and Loudness," J. Audio Eng. Soc., vol. 62, No. 10, Oct. 2014, pp. 1-11.
Deruty, E., "Goal-Oriented Mixing," Proceedings of the 2nd AES Workshop on Intelligent Music Production, London, UK, Sep. 13, 2016, 2 pages.
Fletcher, H., and Munson, W.A., "Loudness, Its Definition, Measurement and Calculation," Journal of the Acoustical Society of America, vol. 5, Oct. 1933, pp. 82-108.
"Acoustique—Lignes isosoniques normales," ISO—International Organization for Standardization 226:2003(F), Aug. 2003, pp. 1-18.
Gonzalez, E.P., and Reiss, J.D., "Automatic mixing tools for audio and music production," Center for Digital Music, Retrieved from the Internet URL: http://c4dm.eecs.qmul.ac.uk/automaticmixing/, 1 page.
Hafezi, S., and Reiss, J.D., "Autonomous Multitrack Equalization Based on Masking Reduction," Journal of the Audio Engineering Society, vol. 63, No. 5, May 2015, pp. 312-323.
John, V., "Multi-Source Room Equalization: Reducing Room Resonances," Convention paper 7262, Oct. 1, 2007, 1 page (Abstract only).
Ma, Z., et al., "Intelligent Multitrack Dynamic Range Compression," Journal of the Audio Engineering Society, vol. 63, No. 6, Jun. 2015, pp. 412-426.
Ma, Z., et al., "Partial Loudness In Multitrack Mixing," AES 53rd International Conference, London, UK, Jan. 27-29, 2014, pp. 1-9.
Mansbridge, S., et al., "Implementation and Evaluation of Autonomous Multi-track Fader Control," AES 132nd Convention, Budapest, Hungary, Apr. 26-29, 2012, pp. 1-11.
Ronan, D., et al., "Analysis of the subgrouping practices of professional mix engineers," Convention Paper, Presented at the 142nd Convention, Audio Engineering Society, Bedin, Germany, May 20-23, 2017, pp. 1-13.
Ronan, D., et al., "Automatic Subgrouping of Multitrack Audio," Proc. of the 18th Int. Conference on Digital Audio Effects (DAFx-15), Trondheim, Norway, Nov. 30-Dec. 3, 2015, pp. DAFX-1 to DAFX-8.
Stavrou, M., "Mixing with your Mind," 2008, 1 page.
Suzuki, Y., and Takeshima, H., "Equal-loudness-level contours for pure tones," The Journal of the Acoustical Society of America, vol. 116, No. 2, Aug. 2004, pp. 918-933.
Ward, D., et al., "Multi-track mixing using a model of loudness and partial loudness," Convention paper 8693, Presented at the 133rd Convention, Audio Engineering Society, San Francisco, USA, Oct. 26-29, 2012, pp. 1-9.
Ward, D., and Reiss, J.D., "Loudness Algorithms for Automatic Mixing," Proceedings of the 2nd AES Workshop on Intelligent Music Production, London, UK, Sep. 13, 2016, 2 pages.

* cited by examiner

| Window | 1 | 2 | 3 | 4 | 5 | ... |
|---|---|---|---|---|---|---|
| Offset | $O_1$ | $O_2$ | $O_3$ | $O_4$ | $O_5$ | ... |

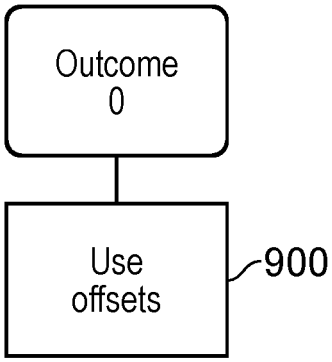
FIG. 11a
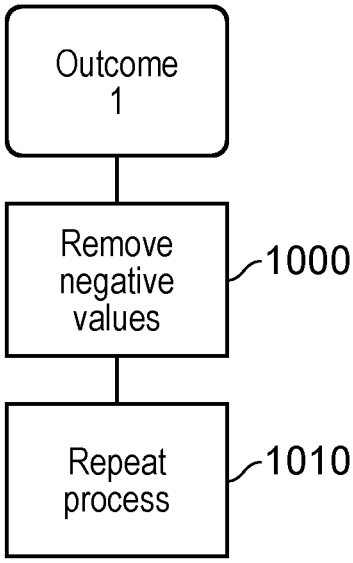
FIG. 11b
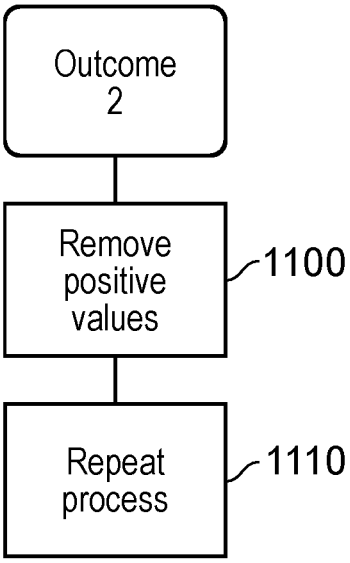
FIG. 11c
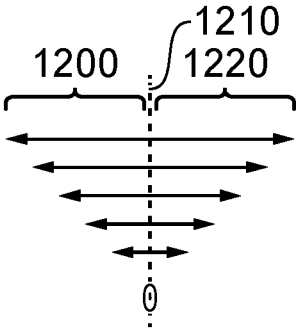
FIG. 12
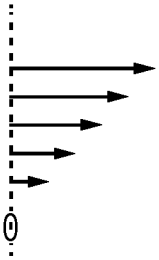
FIG. 13
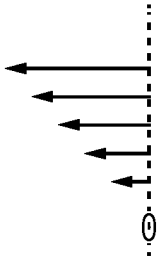
FIG. 14
| Window | 1 | 2 | 3 | 4 | ... | N |
|---|---|---|---|---|---|---|
| Offset | $O_1$ | $O_2$ | $O_3$ | $O_4$ | ... | $O_N$ |
FIG. 15

AUDIO PROCESSING TO COMPENSATE FOR TIME OFFSETS

CROSS-REFERENCE TO RELATED APPLICATIONS

The present application is based on PCT filing PCT/EP2018/071048, filed Aug. 2, 2018, which claims priority to EP 17187985.1, filed Aug. 25, 2017, the entire contents of each are incorporated herein by reference.

BACKGROUND

Field

This disclosure relates to audio processing.

Description of Related Art

The "background" description provided herein is for the purpose of generally presenting the context of the disclosure. Work of the presently named inventors, to the extent it is described in this background section, as well as aspects of the description which may not otherwise qualify as prior art at the time of filing, is neither expressly or impliedly admitted as prior art against the present disclosure.

Stereo audio files are formed of two mono files, for the left and right channel respectively. Identical audio content in both channels will result in the listener perceiving the sound coming from the middle of the two loudspeakers or earpieces. Delayed content in one channel will result in the listener perceiving the sound coming from other locations than the middle. A short delay (for example, of 50 ms (milliseconds)) will result in the listener perceiving the sound coming from both loudspeakers or earpieces simultaneously. A longer delay will result in the listener perceiving the sound coming from the loudspeaker or earpiece from which the sound comes first. Delaying one channel over the other can be intentional or accidental and may vary over time.

SUMMARY

Respective aspects and features of the present disclosure are defined in the appended claims.

It is to be understood that both the foregoing general description and the following detailed description are exemplary, but are not restrictive, of the present technology.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, in which:

FIGS. 11*a* to 11*c* schematically represent respective outcomes from the process of FIG. 8;

FIGS. 12 to 14 schematically represents sets of candidate offsets;

FIG. 15 schematically illustrates a re-evaluated set of offsets;

DESCRIPTION OF THE PREFERRED EMBODIMENTS

Figure 1A:
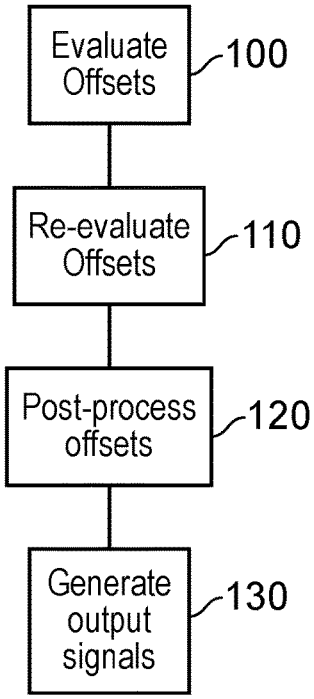
FIG. 1*a* is a schematic flowchart illustrating a method of processing temporal windows of first and second input audio signals.

Referring now to the drawings, FIG. 1*a* is a schematic flow chart illustrating a method of processing first and second input audio signals. An overall aim of the example process is to detect a temporal disparity in the form of time offsets between successive discrete (though potentially overlapping) temporal windows of a pair of input audio signals such as a stereo (left-right) pair, and using those detected time offsets, apply a modification or correction to one or both of the input audio signals to generate a pair of output audio signals (again, such as a stereo pair) having a reduced temporal disparity between the audio content of the two signals.

So, the inputs to the process are first and second input audio signals. The outputs from the process are first and second output audio signals. Data obtained during the process includes a set of time offsets detected in respect of successive temporal windows, such as windows of 1 second in length (though note that—as discussed below—different window lengths may be used in other parts of the overall process). The windows may themselves overlap as discussed below in connection with FIG. 1*b*. The time offsets are used in the generation of the output signals such that the output audio signals are generated so as to aim to compensate for the detected time offsets.

The process of FIG. 1*a* comprises multiple stages in which the time offsets are detected and are then refined before being applied in the generation of the output audio signals.

At a step 100, time offsets between each of a plurality of temporal windows of the first and second input audio signals are evaluated, so as to provide an example of detecting a time offset between respective portions of the first and second input audio signals corresponding to a given temporal window. This process results in the selection of a respective offset for each of the temporal windows, indicating a detected time difference between the two signals.

At a step 110, the offsets are re-evaluated. This process will be described below.

At a step 120, the offsets are post-processed.

Finally, at a step 130, first and second output signals are generated using the evaluated offsets resulting from the preceding three steps.

Figure 1B:
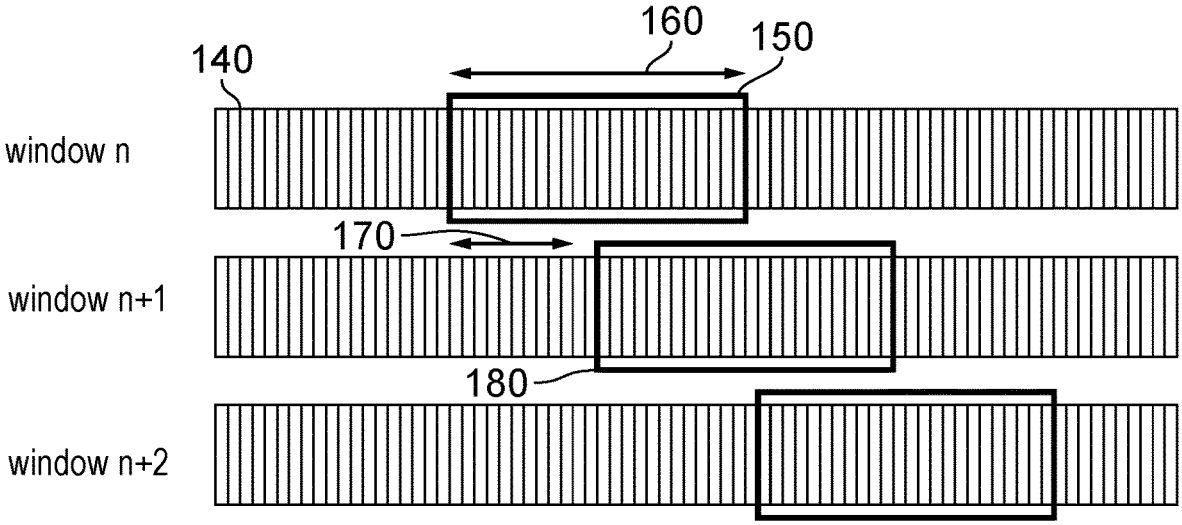
FIG. 1*b* schematically illustrates the use of windows.

FIG. 1*b* schematically illustrates example temporal windows for use in at least the steps 100-120 of FIG. 1*a*. An audio signal (such as one of the input audio signals to the process) is represented by successive vertically oriented rectangles 140 representing respective audio samples. Time is represented along a horizontal axis from the left (earlier) to the right (later). A window length 160 is defined as a period of time and/or a number of audio samples. This is applied at a position 150 for a given window n. For a next window n+1, the window is moved later in time (with respect to the audio signal) by a so-called "hop size" 170. In this example, the hop size is approximately (or in some examples exactly) half of the window length 160. This generates a new window n+1 180. The process is repeated again to generate the next window n+1, and so on. It will be appreciated therefore that the windows encompass all samples at least once, and depending on the ratio of the hop size to the window length, may encompass some samples more than once, for example twice. In the present examples, the window length 160 might be 1 second, and the hop size 0.5 second.

Figure 2:
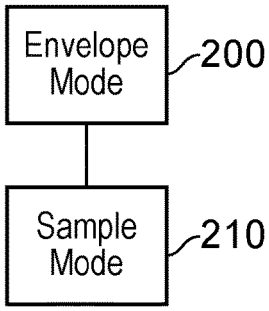
FIG. 2 is a flowchart schematically illustrating plural modes of operation.
Figure 3A:
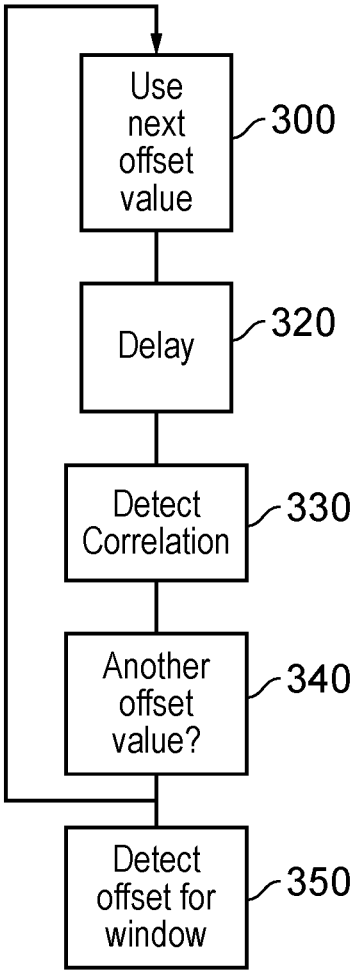
FIG. 3*a* is a flowchart schematically illustrating an offset evaluation process.

The method described with respect to FIG. 1*a* can be performed in either of two modes, an envelope mode and a sample mode. Differences between these two modes of operation will be discussed below. Referring to FIG. 2, in some examples, the method can be performed in one of those modes followed by the other as a cascaded process, for example according to the envelope mode at a step 200 followed by the sample mode at a step 210 resulting in the potential selection of two sets of different time offsets for each temporal window FIG. 3*a* schematically illustrates a process forming part of the evaluation of offsets in the step 100 mentioned above. The process uses multiple possible or candidate offset values. The process as illustrated is carried out serially as a loop—one iteration for each candidate offset value, but in other examples could be carried out as a parallel operation. The overall process of FIG. 3*a* is carried out once for each temporal window.

An example set of candidate offset values (expressed in milliseconds) is as follows:

{−10; −8; −6; −4; −2; 0; +2; +4; +6; +8; +10}

Here, the polarity or sign of the offset refers to which of the two signals is detected to temporally precede the other. A negative offset refers to the first input audio signal preceding the second input audio signal. A positive offset refers to the second input audio signal preceding the first input audio signal. However, it will be appreciated that the choice of what is represented by each offset sign is an arbitrary design decision. This candidate set of offset values is illustrated schematically in FIG. 12 to be discussed below.

At a step 300, the process refers to a next candidate offset value to be considered in the set of candidate offset values (in an iteration of a looped operation) such as an example offset value 310 of −10 ms.

The following steps refer to the sample mode discussed above, in that in a step 320, respective portions 322, 324 of the first and second input audio signals for a current temporal window under test are relatively offset by the offset amount 310. A delay of a magnitude equal to the magnitude of the offset under test is applied to the portion (for the current temporal window) of that one of the input audio signals which—according to the sign of the candidate offset value under consideration—is assumed to be preceding the other.

The step 330 therefore provides an example of detecting a correlation between sample values of the respective portions, subject to a relative delay between the respective portions dependent upon a time offset under test. At a step 350, a correlation meeting the predetermined criterion may be a greatest correlation amongst the correlations detected for each of the group of candidate time offsets under test.

The steps 320-350 therefore provide an example of detecting a correlation between one or more properties (such as sample value, or in FIG. 3*b*, envelope) of the respective portions according to each of a group of candidate time offsets under test; and selecting, as a detected time offset for the given temporal window, an offset for which the detecting step (i) detects a correlation which meets a predetermined criterion (such as a greatest correlation).

So, the result of the process of FIG. 3*a* is the selection or detection of an offset applicable to each temporal window. As mentioned above, these detected offsets are provisional in that the subsequent steps 110, 120 can in fact change some of the detected offsets.

Figure 3B:
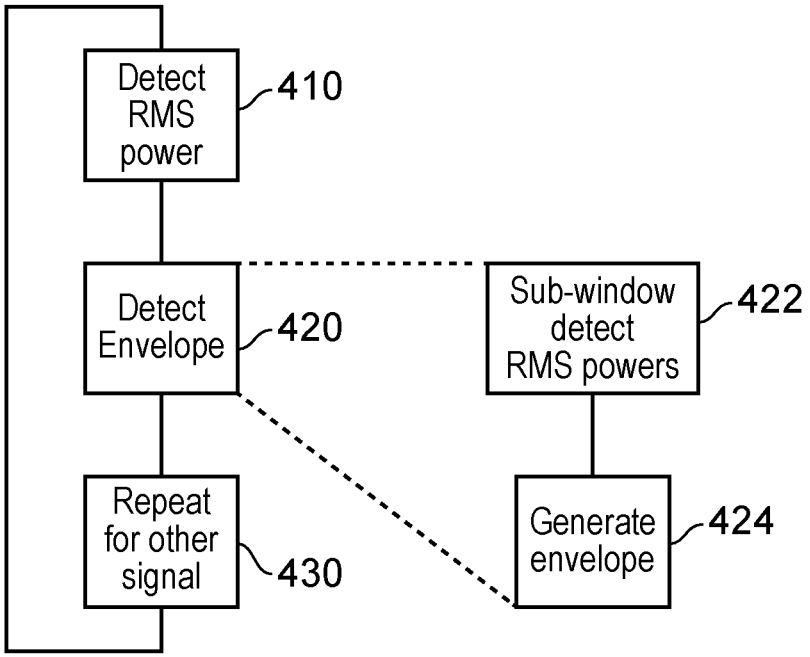
FIG. 3*b* schematically illustrates an envelope mode.

In an envelope mode, a method according to FIG. 3*b* can be used in place of the step 320. Here, for a temporal window under test, an RMS (root mean square) power value 400 is detected at a step 410 for each of the two input audio signals in the temporal window under test. The RMS power value 400 can be used in a process to be described in connection with FIG. 6 below.

At a step 420, which can be expressed as two sub-steps 422, 424, an envelope is detected by dividing a portion of an input audio signal under test, corresponding to a temporal window of one of the signals, into multiple contiguous sub-windows and detecting the RMS power of each sub window. At the step 424, an envelope is detected in dependence upon the multiple RMS power values for the sub-windows. Then, at a step 430, this process is repeated for the other of the input audio signals at that temporal window. The step 330 (of detecting correlation) is applied to the envelopes detected in this way.

FIG. 3*b* therefore provides an example of detecting (410, 420) for the respective portions of the first and second input audio signals, an envelope function in dependence upon signal power in each of a plurality of contiguous sub-windows of the respective portions; The steps 330, 350 as applied to the envelopes, in the envelope mode, provides an example of applying a time offset under test to one of the envelope functions to generate an offset envelope function; and detecting a correlation between the offset envelope function and the other of the envelope functions.

The step 330 can then be replaced by a process in which one of the envelope signals is delayed (by an amount depending on the magnitude of the candidate offset under test, and with the selection of which envelope is delayed depending on the sign of the offset under test, as discussed above). A correlation is then obtained between the relatively delayed envelope signals. The offset is selected at the step 350 by comparing these correlations.

Figure 4A:
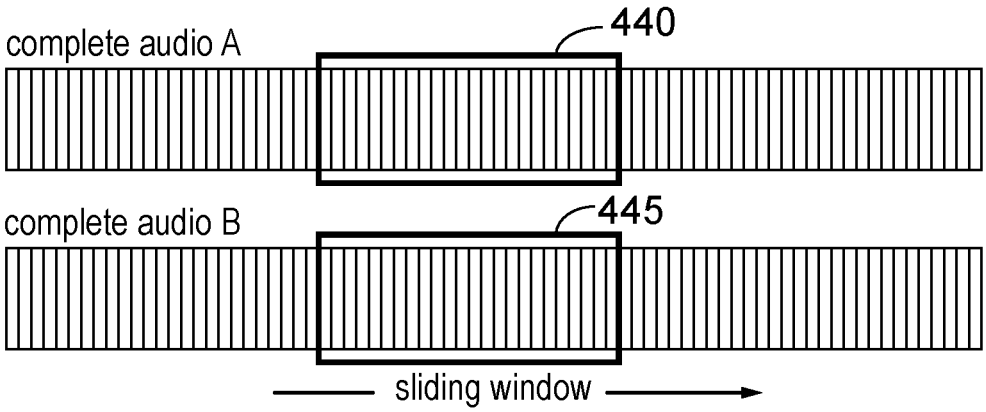
FIG. 4*a* schematically illustrates the use of so-called sliding windows.
Figure 4B:
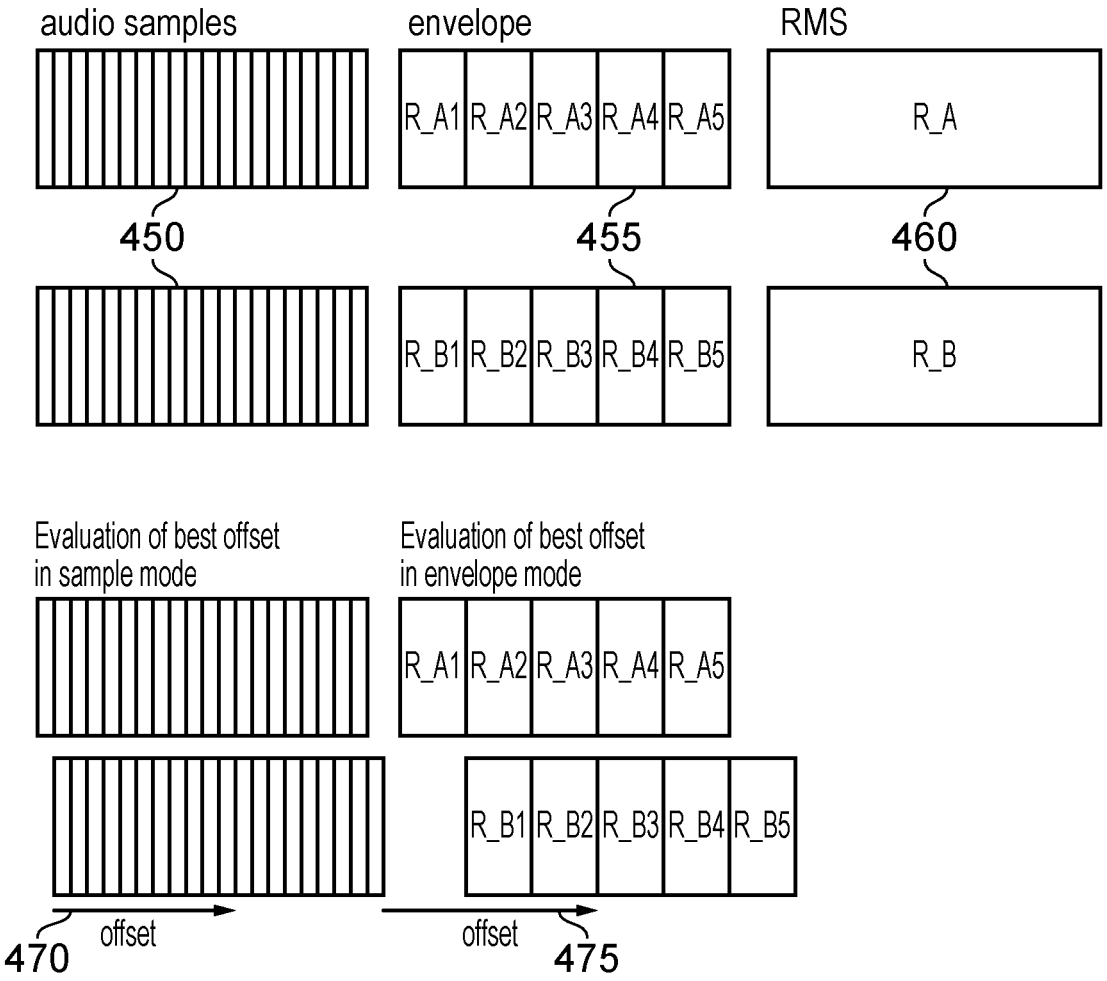
FIG. 4*b* schematically illustrates the evaluation of an offset.
Figure 4C:
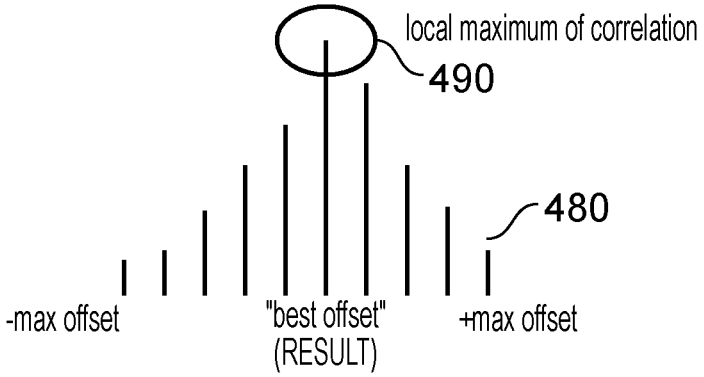
FIG. 4*c* schematically illustrates a set of correlation values.

FIGS. 4*a* to 4*c* provide some example schematic illustrations of these processes.

FIG. 4*a* schematically illustrates a pair of windows 440, 445 in two input audio signals A and B. For a particular iteration of the present process, the windows are aligned in time. But the windows are referred to as "sliding windows" in FIG. 4*a* because of the process discussed in connection with FIG. 1*b* above, in that the window position is advanced (or "slides") from iteration to iteration of the process.

FIG. 4*b* schematically illustrates, for an example pair of windows such as the windows 440, 445, a pair of sets 450 of audio samples, a pair of sets 455 of RMS power values for sub-windows derived from the windows 440, 445, and a pair 460 of RMS power values for the whole windows.

FIG. 4*b* also schematically illustrates the evaluation process according to the sample mode, in which the samples for a window are relatively offset by a candidate offset value 470 under test, or according to the envelope mode, in which the RMS power values for the sub-windows are relatively offset by a candidate offset value 475 under test, and a correlation value generated.

FIG. 4*c* provides an illustration of a set of correlation values 480 corresponding to candidate offsets from a most negative offset (−max offset) to a most positive offset (+max offset), with a local maximum correlation 490 (which indicates the "best" offset value, or the offset value to be associated with that window position) to be selected.

Figure 5:
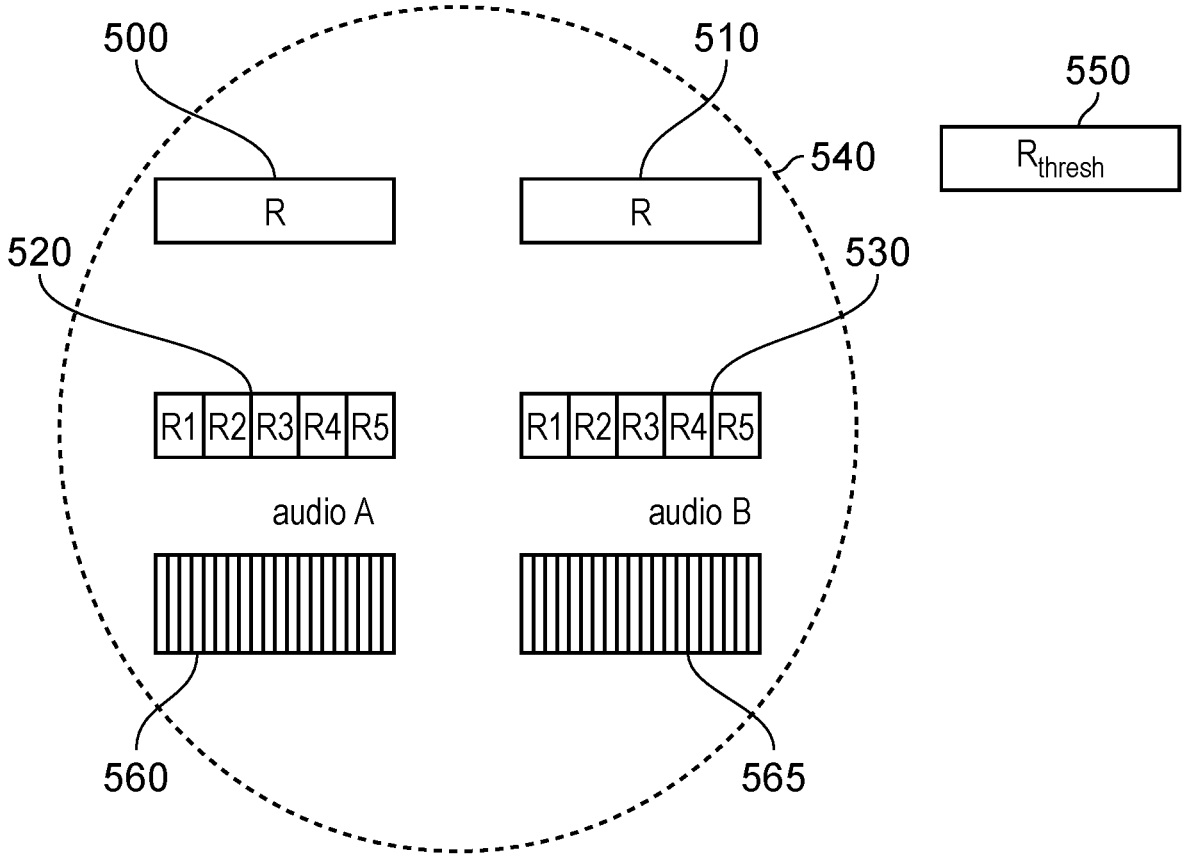
FIG. 5 schematically illustrates an ensemble of data.

The result of the process shown in FIG. 3*b* is that for each of the input audio signals an RMS power value 500, 510 (FIG. 5) is generated and an envelope 520, 530 is also generated. Together with the sample values 560, 565 of the relevant window, this forms an ensemble 540 of data associated with the temporal window. A threshold RMS power $R_{thresh}$ 550 will also be referred to below.

Figure 6:
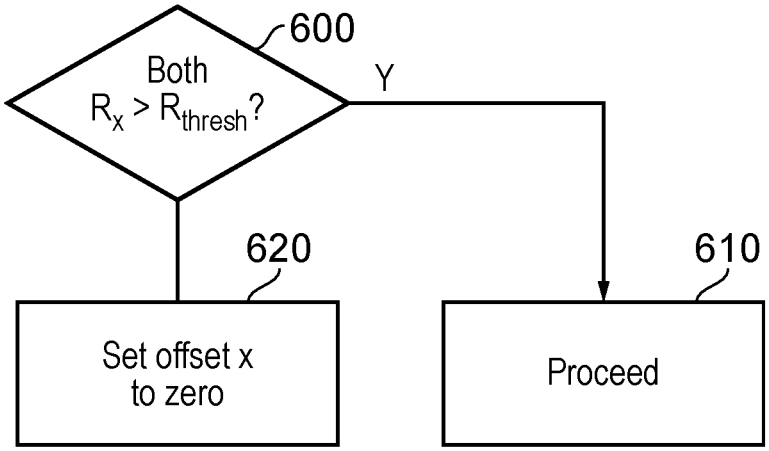
FIG. 6 schematically illustrates an offset zeroing operation.

FIG. 6 schematically illustrates a method which can follow the step 350 in FIG. 1*a*, in which, for each temporal window, for each input audio signal, the respective RMS power $R_x$ is tested against a threshold RMS power $R_{thresh}$ at a step 600. If $R_x > R_{thresh}$ for both windows (that is to say, of the two input audio signals) at a particular window position then control passes to a step 610 and the process proceeds as described below. Otherwise, control passes to a step 620 at which the offset associated with that temporal window is set to 0.

For example, the threshold RMS power $R_{thresh}$ can be set to a value indicative of a noise floor so that if the RMS power in one of the signals in a particular temporal window is not greater than the threshold RMS power indicative of noise, it is assumed that at least one of the signals contains no useful information and the offset for that temporal window is set to 0. This can avoid the offset detection process being corrupted by trying to compare correlations between noisy signals.

Therefore, the process of FIG. 6 can provide an example of selecting a zero offset for any temporal window for which the respective portions of the first and second input audio signals have less than a threshold average power.

Figures 7, 8:
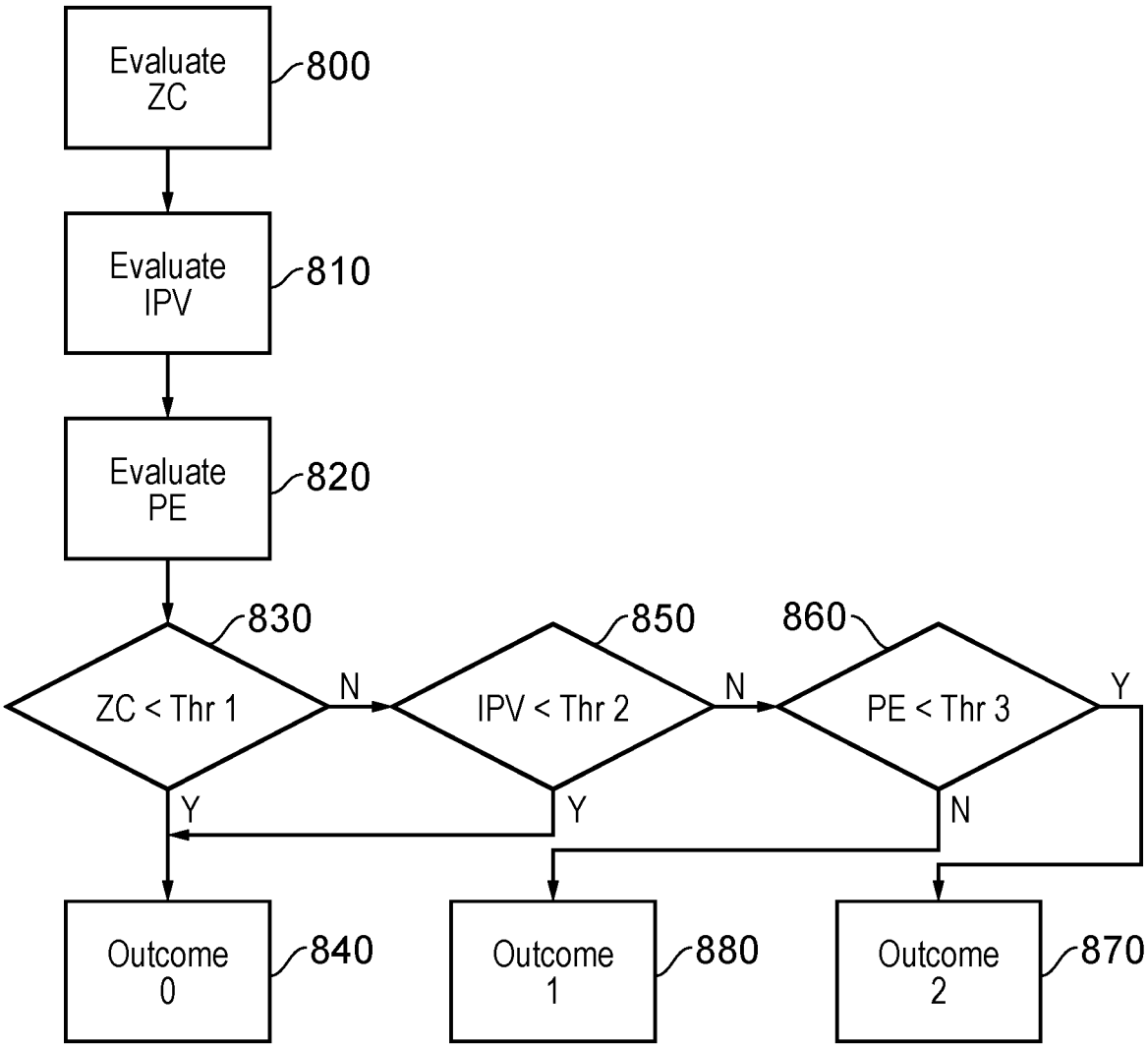
FIG. 7 schematically illustrates a set of offsets.
FIG. 8 schematically illustrates a re-evaluation operation.

A process corresponding to the step 110, re-evaluation of offsets, will now be described with reference to FIGS. 7 and 8. FIG. 7 schematically illustrates a succession of offset values $O_1 \ldots O_5$ corresponding to temporal windows 1 . . . 5, representing the provisional output of the process of FIG. 3*a*, optionally followed by the process of FIG. 6.

The step 110 involves detecting properties of the series of offsets.

At a step 800 in FIG. 8, the number of zero crossings (ZC) is evaluated. A zero crossing occurs, as between two successive offset values $O_n$ and $O_{n+1}$ there is a change of polarity or sign. The step 800 involves counting the number of zero crossings amongst the whole set of offset values. This can be expressed as a proportion of the total number of offset values (that is to say, the total number of temporal windows), for example.

At a step 810, the inter-percentile value (IPV) of the offset values $O_x$ is evaluated, for example between two predetermined percentiles such as 25% and 75%. The lower percentile is subtracted from the higher percentile, generating the inter-percentile value.

At a step 820, the number of positive elements (PE) in the group of offsets of FIG. 7 is detected. This represents the number of offset values $O_1 \ldots O_n$ which have a positive sign.

Control then passes to a step 830. At the step 830, the number of zero crossings (ZC) is compared to a first threshold Thr1. If ZC<Thr1 then control passes to a step 840 representing an outcome 0 to be discussed below. If not, control passes to a step 850 at which the inter-percentile value IPV is compared with a second threshold Thr2. If IPV<Thr2 then control also passes to the step 840. If not, control passes to a step 860 at which the number of positive elements PE is compared with a third threshold Thr3. If PE<Thr3 then control passes to a step 870 representing an outcome 2. Otherwise, control passes to a step 880 representing an outcome 1 to be discussed below.

Figure 9:
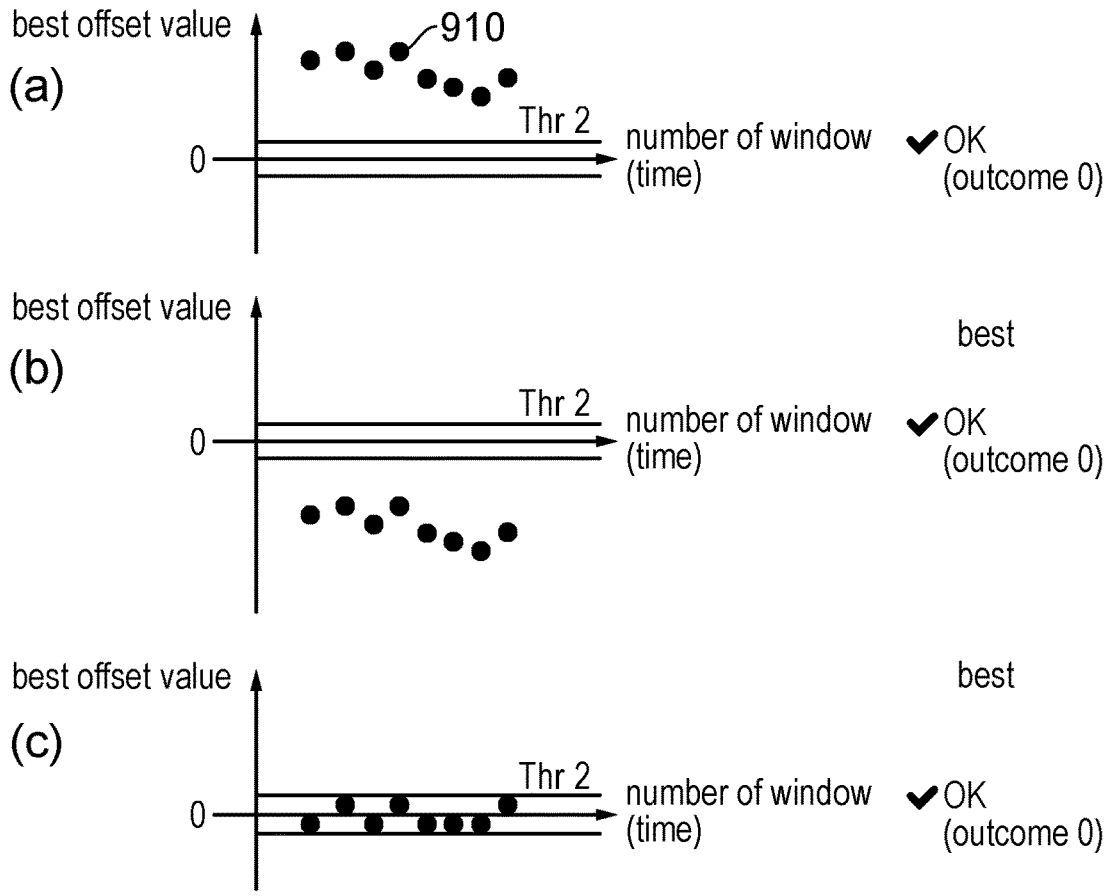
FIGS. 9 and 10 provide schematic illustrations of outcomes of the process of FIG. 8.
Figure 10:
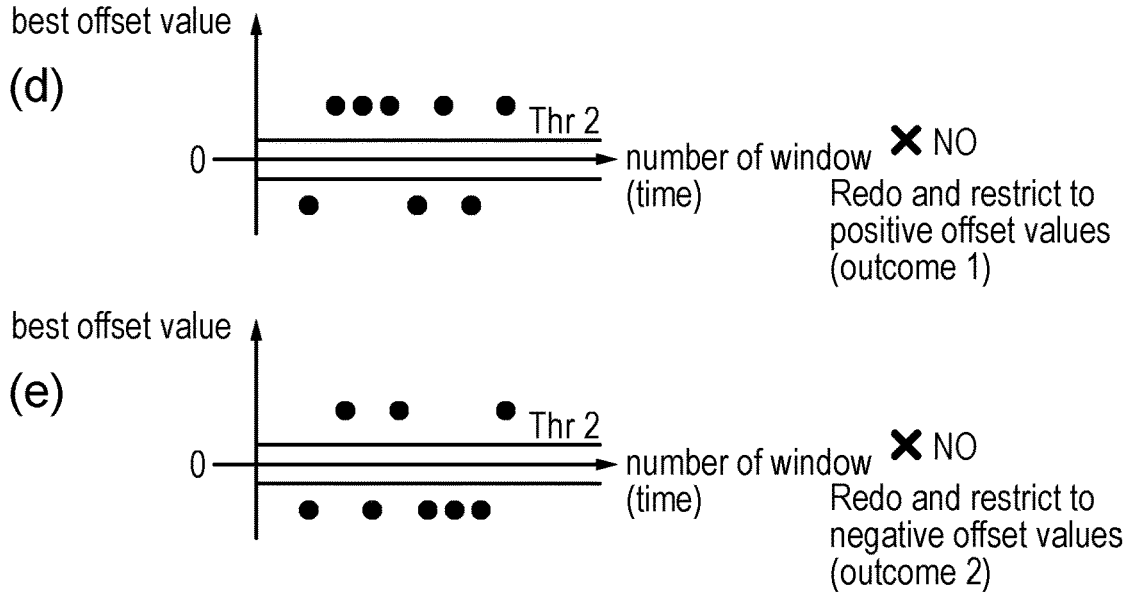

FIGS. 9 and 10 provide schematic illustrations of these outcomes. In each of the representations of FIGS. 9 and 10, window position (time) is represented along a horizontal axis, from earlier (left) to later (right). Individual dots 910 represent the offsets associated with each window position by the step 100. Offset values are represented on a vertical axis from negative (lower) to positive (upper) positions.

In FIG. 9(*a*), all of the offsets are positive. There are no zero crossings, so outcome 0 is selected.

In FIG. 9(*b*), all of the offsets are negative. There are no zero crossings, so outcome 0 is selected.

In FIG. 9(*c*), there are zero crossings but the inter-percentile value falls in the test range defined by Thr2. So outcome 0 is selected.

In FIG. 10(*d*) there are more than Thr1 zero crossings. So the step 830 has a negative outcome. The IPV is outside the range defined by Thr2, so control passes to the step 860. At the step 860, the number PE is not less than Thr3 so the result is the outcome 1.

In FIG. 10(*e*) there are more than Thr1 zero crossings. So the step 830 has a negative outcome. The IPV is outside the range defined by Thr2, so control passes to the step 860. At the step 860, the number PE is less than Thr3 so the result is the outcome 2.

FIGS. 11*a* to 11*c* schematically represent processing carried out in respect of the outcomes 0, 1, 2. In particular, FIG. 11*a* schematically represents the outcome 0 in which, at a step 900, the offset values of FIG. 7 (as they were input to the process of FIG. 8) are used in their existing form.

Regarding the outcome 1, in FIG. 11*b*, the set of candidate offsets is modified so as to remove any negative values at a step 1000 and, at a step 1010, the process of FIG. 1*a* is repeated using the modified set of candidate offsets. Similarly, regarding the outcome 2, at a step 1100 in FIG. 11*c*, the set of candidate offsets as modified so as to remove all positive values and at a step 1110 the process of FIG. 1*a* is repeated.

This re-evaluation process provides an example of detecting one or more properties of the time offsets detected for the plurality of temporal windows; and if the time offsets detected for the plurality of temporal windows meet one or more second predetermined criteria, modifying the group of candidate time offsets under test and repeating the step of detecting a time offset using the modified group of candidate time offsets under test.

The second predetermined criteria may comprise:

a criterion that more than a threshold proportion of the time offsets selected for the plurality of temporal windows exhibit a sign change between time offsets selected for adjacent temporal windows (ZC>Thr1); and a criterion that a spread of the time offsets selected for the plurality of temporal windows exceeds a threshold spread (IPV>Thr2); and a criterion that at least a threshold proportion of the time offsets selected for the plurality of temporal windows have a predetermined sign (PE>Thr3);

and the step of modifying the group of candidate time offsets under test comprises removing candidate time offsets having one sign.

FIG. 12 schematically represents the set of candidate offsets referred to above, as multiple negative sign offsets 1200, a 0 value candidate offset 1210 and multiple positive sign candidate offsets 1220. FIG. 13 represents the set of FIG. 12 with all the negative values removed and FIG. 14 schematically represents the set of FIG. 12 with all the positive values removed. Using the specific example given above, the sets may be considered as follows:

(negative values removed): {0; +2; +4; +6; +8; +10}

(positive values removed): {−10; −8; −6; −4; −2; 0}

The evaluation of offsets and revaluation of offsets at the steps 100, 110, in some cases involving the repetition of the evaluation step 100, result in a set of offsets shown schematically in FIG. 15 for windows 1 . . . N and offsets $O_1 \ldots O_n$.

Figure 16:
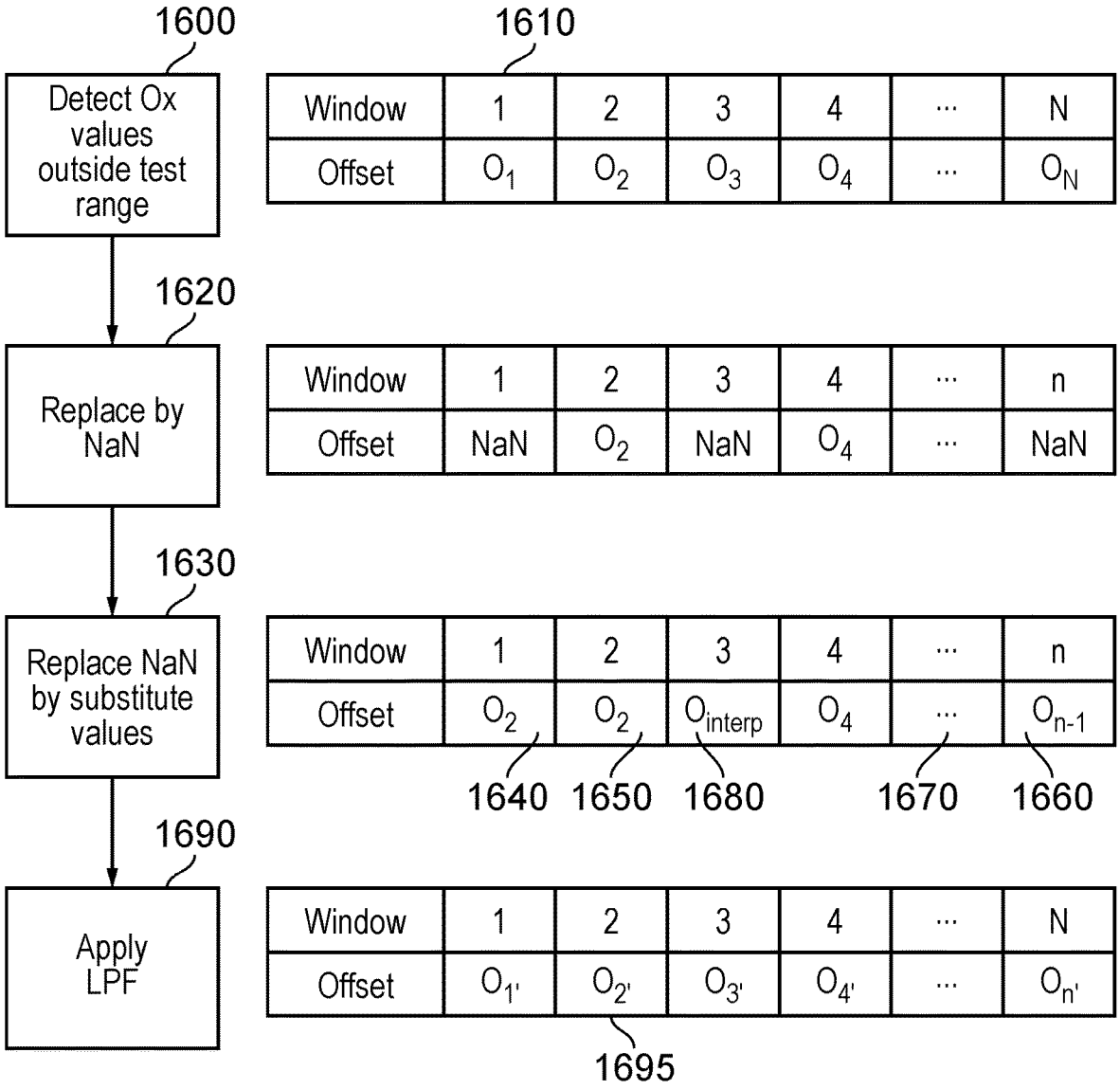
FIG. 16 schematically represents a post-processing operation.

With regards to this set of offsets, FIG. 16 provides an example of the post processing referred to as the step 120 discussed above.

At a step 1600, amongst the set of offsets 1610 any offset values $O_x$ outside a test range are detected and, at a step 1620 are replaced by a flag or indicator referred to as "not a number" (NaN). For example, the test range may be a range between predetermined percentiles such as the $25^{th}$ and $75^{th}$ percentiles in the distribution of offsets. In FIG. 16, it is assumed that the offsets $O_1$, $O_3$ and $O_N$ are detected to be outside of the test range. Then, at a step 1630, any NaN values are replaced by substitute values. In the case of one or more first offset values, such as an offset value 1640, this is replaced by a next adjacent retained offset value 1650. A last offset value 1660 is replaced by a next adjacent retained offset value 1670. In these examples, for one or more first or last offsets amongst the time offsets selected for the plurality of temporal windows, the process may include substituting a next-adjacent non-substituted time offset value. An intermediate offset value, not being a first or last in the series (such as an offset value 1680) is replaced by an interpolated value, such as a linearly interpolated value between two adjacent offset values. So, for other time offsets amongst the time offsets selected for the plurality of temporal windows, the process may include interpolating a replacement time offset value from surrounding non-substituted time offset values. In the example of FIG. 16, $O_{interp}=(O_2+O_4)/2$.

Finally, at a step 1690 a low pass filter (LPF) can optionally be applied to generate low pass filtered offset values 1695. An example set of parameters for the LPF is: order 2, frequency cut-off 0.05.

The process of FIG. 16 therefore provides an example of detecting a distribution of time offsets amongst the time offsets selected for the plurality of contiguous or overlapping temporal windows; and substituting replacement time offset values for any ones of the selected time offsets having at least a threshold difference from a median time offset (for example, outside the $25^{th}$-$75^{th}$ percentiles).

This overall process results in the generation of post-processed offsets $O_{1'} \ldots O_{n'}$ for the windows 1 . . . N.

Figure 17:
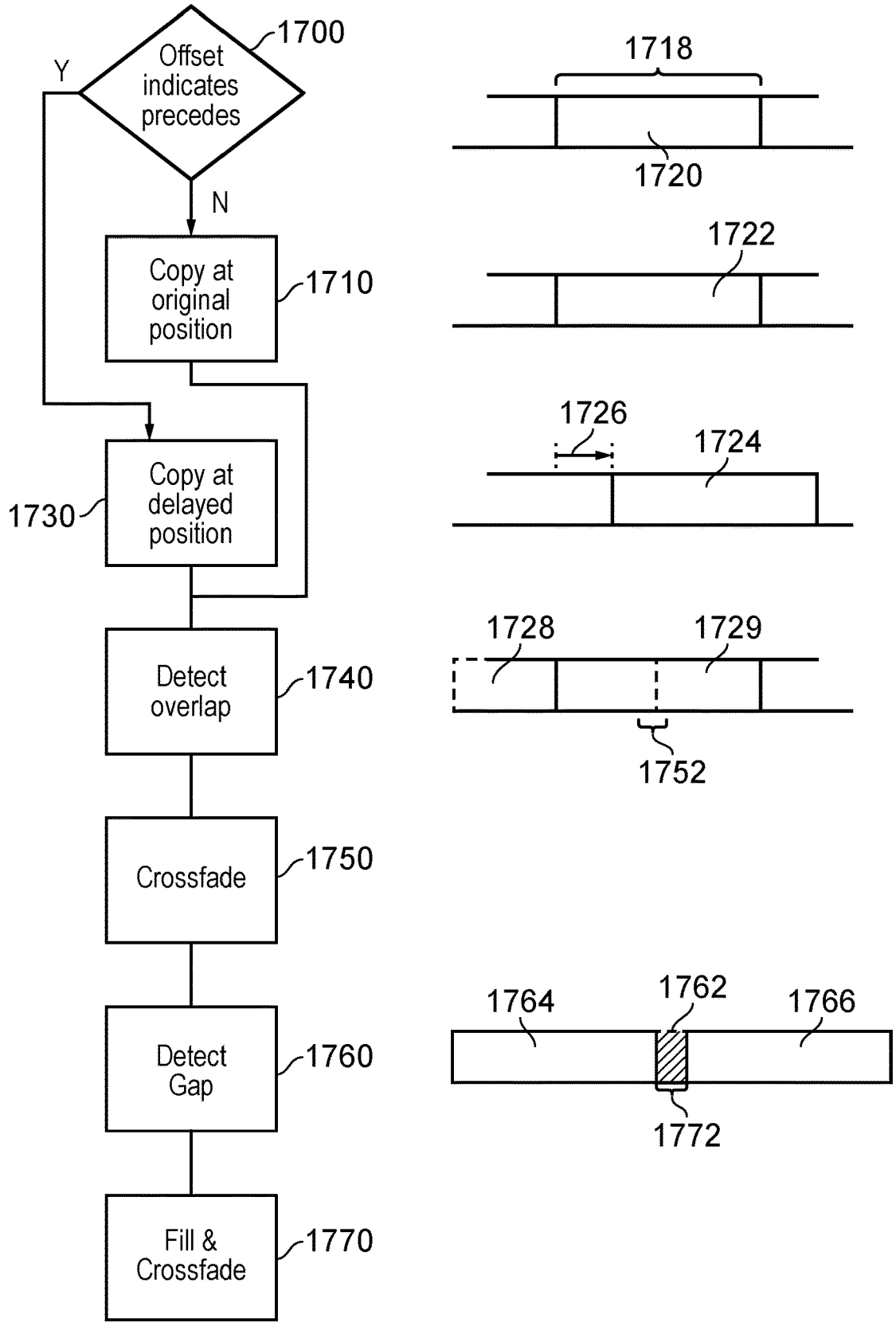
FIG. 17 schematically represents an output generation process.

FIG. 17 is a schematic flowchart representing an example of the set 130 of FIG. 1*a*.

The process of FIG. 17 can be performed using temporal windows which are smaller (for example, having a length of 0.2 seconds and a hop size of 0.1 seconds) than those used in the detection of the offset values. Offsets for use with the smaller temporal windows can be interpolated from the offsets associated with the larger temporal windows. This provides an example of performing the step 100 using first temporal windows of a first window size; and performing the step 130 using second temporal windows of a second window size smaller than the first window size; in which the step 130 comprises interpolating an offset value associated with each second temporal window from the offsets detected for the first temporal windows.

For each temporal window in use for the step 130, the series of steps of FIG. 17 can be carried for each of the two input audio signals, using the post-processed offsets $O_{1'} \ldots O_{n'}$ for the windows 1 . . . N. As noted above, the sign of an offset indicates whether the first or second audio signal is considered to precede the other of the input audio signals.

The process of FIG. 17 is carried out for each (first and second) input audio signal, to generate a respective (first and second) output audio signal. So, the discussion below refers to the performance of this process for a particular one of the first and second input audio signals.

Starting with a step 1700, if the offset associated with the current temporal window 1718 has a sign indicating that the input audio signal under consideration precedes the other input audio signal, then control passes to a step 1730 at which the portion 1720 is copied to the output audio signal as a delayed portion 1724, delayed by an amount 1726 represented by the offset associated with the temporal window (time is schematically represented horizontally, earlier to the left, later to the right). If not, control passes to a step 1710 at which a portion 1720 of the input audio signal is copied to the respective output audio signal as a portion 1722 at its original temporal position, which is to say at the temporal position of the window 1718.

Bearing in mind that a particular offset will indicate one but not the other signal is the signal which precedes (the offset value of 0 can be treated as a special case and arbitrarily treated as indicating that one signal precedes the other), the steps 1700, 1710, 1730 provide an example of: for each temporal window, if (at the step 1700) the detected offset for that temporal window indicates that the first input audio signal precedes the second input audio signal:

(i) generating (1730) a portion of the first output audio signal by delaying a portion of the first input audio signal for that temporal window by the detected offset for that temporal window and generating (1710) a portion of the second output audio signal by reproducing the portion of the second input audio signal for that temporal window;

or otherwise:

(ii) generating (1730) a portion of the second output audio signal by delaying a portion of the second input audio signal for that temporal window by the detected offset for that temporal window and generating (1710) a portion of the first output audio signal by reproducing the portion of the first input audio signal for that temporal window.

At a step 1740, any overlap between a previously generated portion 1728 of the output audio signal and the just-generated portion 1729 is detected and, at a step 1750, a cross fade, for example over a period of 0.1 seconds 1752 is applied. This can be applied at a reference position such as a position half way through the temporal window 1718 under consideration.

At a step 1760, any gap 1762 between a previously generated portion 1764 and a just-generated portion 1766 is detected. At a step 1770, the gap is filled by audio from that input audio signal which followed the portion 1764 in the original input audio signal and a cross fade is applied over a period 1772 of for example 0.1 seconds.

As discussed above, for example, the first and second input audio signals may be left and right signals of an input stereo signal; and the first and second output audio signals may be left and right signals of an output stereo signal.

The steps discussed above provide examples of:

in the case of a time gap between the delayed portion and a previously generated portion of the first (second) output audio signal, generating (1770) a further portion, being a portion of the first (second) input audio signal following the previously generated portion; and cross-fading (1770) the delayed portion with any temporally overlapping previously generated portion of the first (second) output audio signal.

Figure 18:
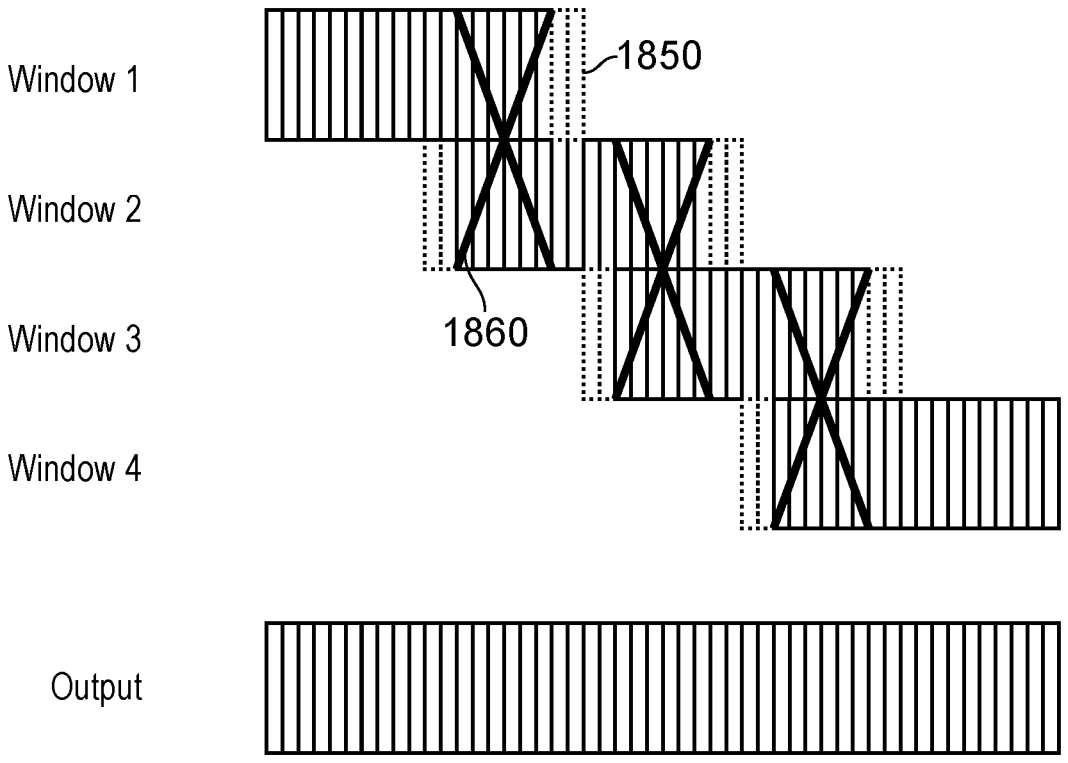
FIGS. 18 to 22 schematically illustrate aspects of a crossfading process.
Figure 19:
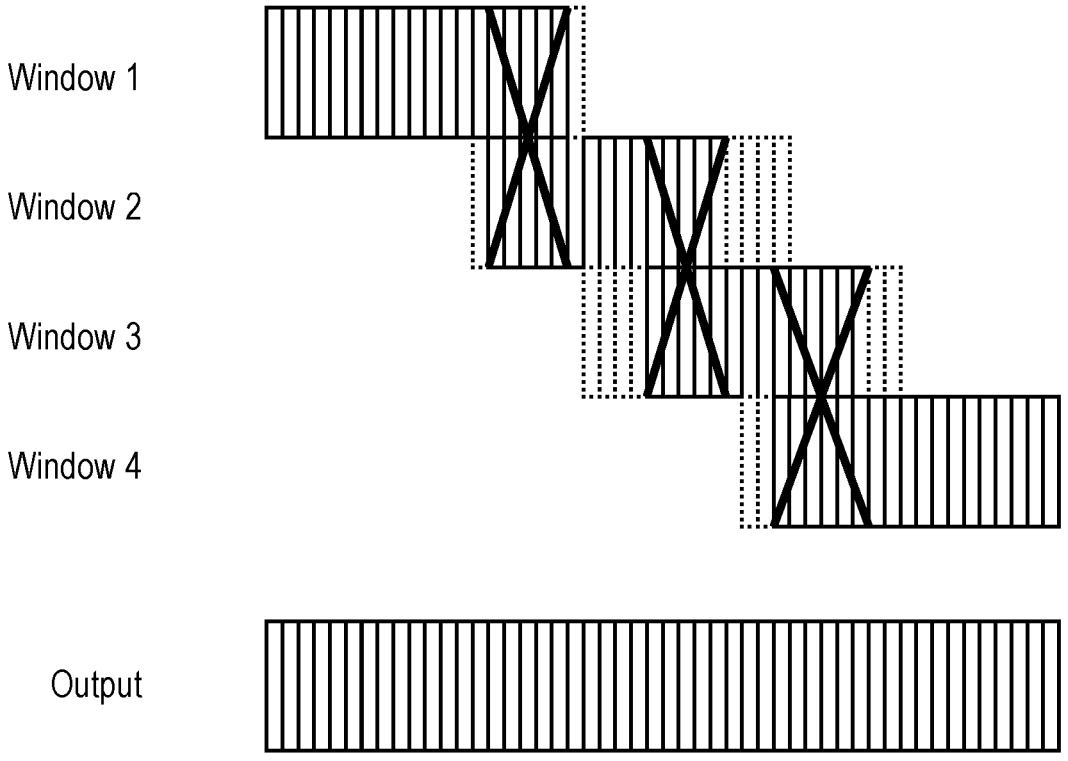
Figure 20:
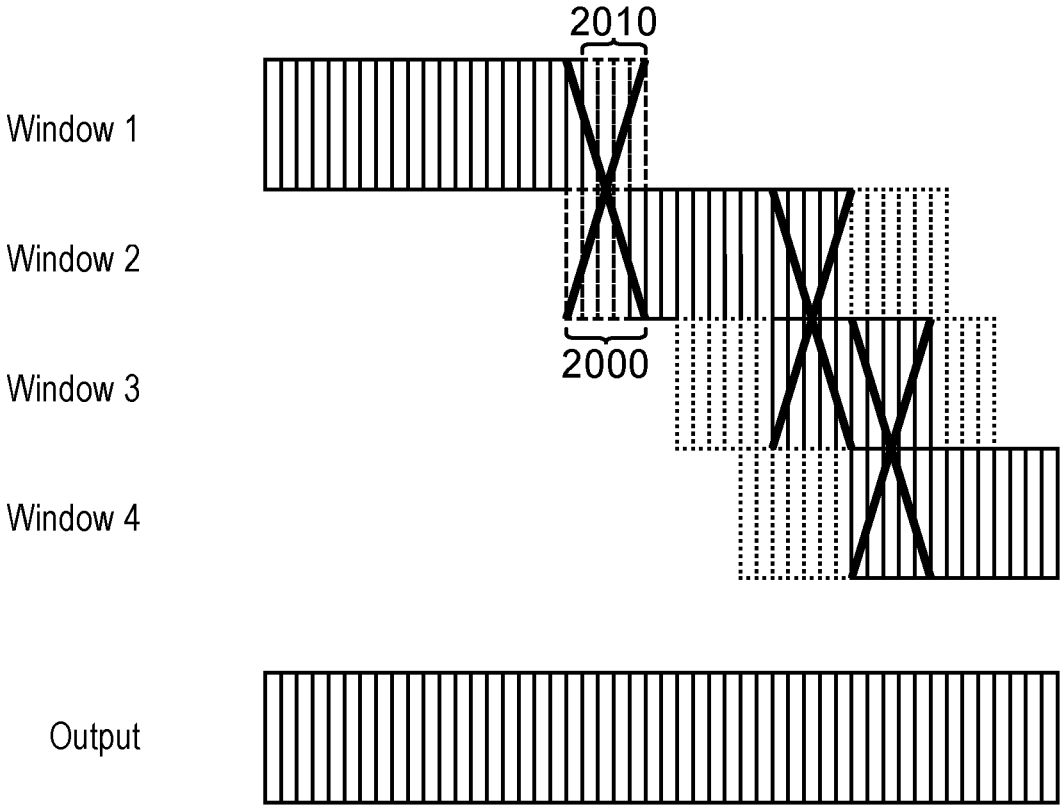

FIGS. 18 to 22 schematically illustrate aspects of the cross-fading process. Each of FIGS. 18 to 20 provides a schematic example relating to one channel such as one output audio channel of the pair of output audio channels, in which the hop size (discussed above) is one half of the window size.

FIG. 18 provides a schematic example relating to a crossfade length of six samples (where successive samples are represented by vertically oriented rectangles in the diagram). A linear crossfade (as one example of a suitable crossfade) is represented by an X 1860 in the diagram. The offset in FIG. 18 is assumed to be zero.

With regard to the Window 2 in FIG. 18, the samples of this window temporally overlap with samples of Window 1 (representing in this context a previously generated portion of the output audio signal). A linear crossfade is performed between the first six samples of the Window 2 and the last six samples of the Window 1. Samples outside (before, in Window 2, or after, in the case of Window 1) of this crossfade region (shown greyed out as samples 1850) are ignored.

In FIG. 19, a positive offset of one sample is assumed, so that Window 2 is offset one sample position to the right (as drawn) relative to Window 1, Window 3 is offset one samples position to the right relative to Window 2, and so on. Here, the overlap over which a crossfade takes place is reduced by one sample, so a crossfade length of five samples is used. Once again, greyed out samples before and after the relevant windows are discarded.

In FIG. 20, the offset is assumed to be longer than the hop size, so that there is no overlap between the windows themselves. However, as discussed above, samples 2010 (in the case of Window 1) and 2000 (in the case of Window 2) which are from the original input signal and which are contiguous to the Windows are used, with a crossfade employed between them.

Figure 21:
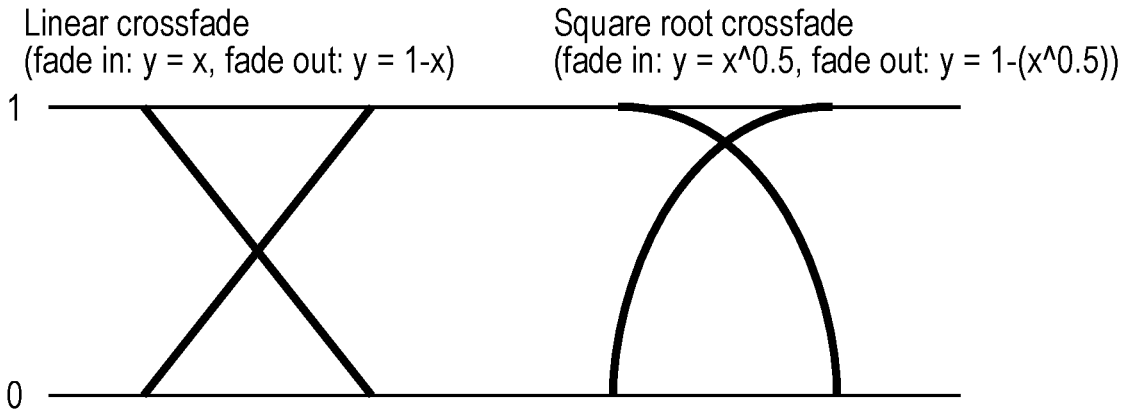

FIG. 21 schematically illustrates two examples of crossfade functions, namely a linear crossfade where:

for the samples fading in, the proportion y of each samples is proportional to x (the sample position in time from the start of the crossfade, normalised to the length of the crossfade); and for the samples fading out, y is proportional to 1-x;

and a square root (sqrt) crossfade in which:

for the samples fading in, y is proportional to sqrt(x); and for the samples fading out, y is proportional to 1-sqrt(x).

A generalised formula for the crossfade is:

for the samples fading in, y is proportional to x^r; (where x^r signifies x to the power of r) and for the samples fading out, y is proportional to 1-x^r.

Figure 22:
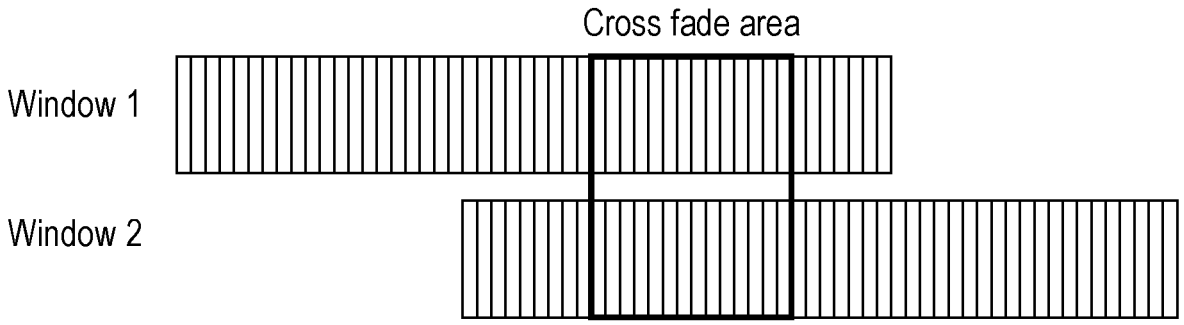

Example embodiments can use a fixed parameter r (such as 1 or 0.5 in the two earlier examples) or can determine the parameter r by detecting the correlation between the groups of samples to be crossfaded, in a crossfade area such as that shown schematically in FIG. 22. If the correlation is 1, indicating that the groups of samples are identical, then r=1. If the correlation is 0, indicating that the groups of samples are different, then r=0.5. A generalised relationship can be used such that:

$$r=0.5+(0.5*\text{correlation})$$

This provides an example of selecting a crossfade parameter or function in dependence upon the correlation between portions to be crossfaded.

Therefore, in these examples, the generating of the output audio signals comprises:

in the case of a time gap between the delayed portion and a previously generated portion of the first output audio signal, generating one or more further portions, being one or both of a portion of the first input audio signal following the previously generated portion and a portion of the first input audio signal preceding the delayed portion; and cross-fading the delayed portion and any further portion with any temporally overlapping previously generated portion of the first output audio signal;

and in which the generating step (iv) comprises:

in the case of a time gap between the delayed portion and a previously generated portion of the second output audio signal, generating one or more further portions, being one or both of a portion of the second input audio signal following the previously generated portion and a portion of the second input audio signal preceding the delayed portion; and cross-fading the delayed portion and any further portion with any temporally overlapping previously generated portion of the second output audio signal.

Figure 23:
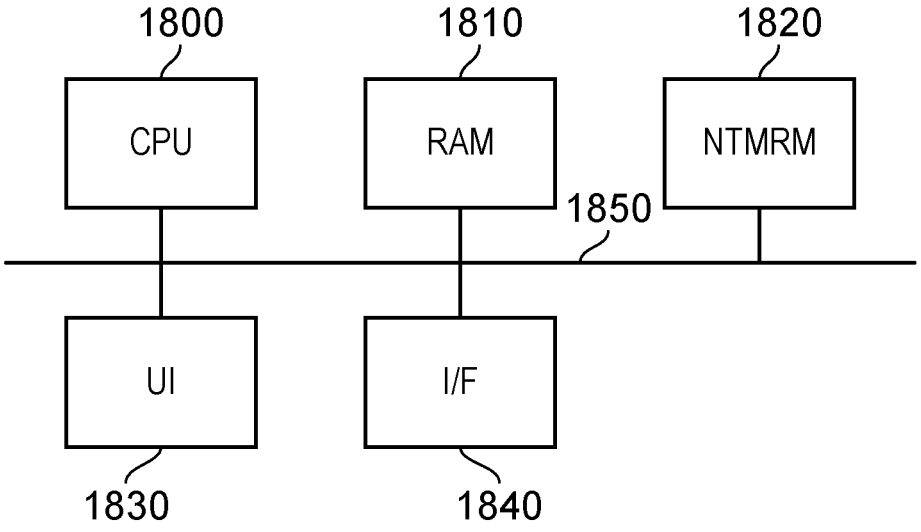
FIG. 23 schematically illustrates an audio processing apparatus.

FIG. 23 schematically illustrates a data processing apparatus suitable to carry out the methods carried out above, comprising a central processing unit or CPU 1800, a random access memory (RAM) 1810, a non-transitory machine readable memory (NTMRM) 1820 such as a flash memory, a hard disc drive or the like, a user interface such as a display, keyboard, mouse, or the like 1830, and an input/output interface 1840. These components are linked together by a bus structure 1850. The CPU 1800 can perform any of the above methods under the control of program instructions stored in the RAM 1810 and/or the NTMRM 1820. The NTMRM 1820 therefore provides an example of a non-transitory machine-readable medium which stores computer software by which the CPU 1800 performs the method or methods discussed above.

Therefore, FIG. 23 provides an example of audio processing apparatus to process first and second input audio signals (which may be received via the interface 1840, for example) to generate first and second output audio signals (which may be output via the interface 1840, for example), the apparatus comprising:

processing circuitry (1800) configured to generate each of a plurality of temporal windows of the first and second output audio signals by:

detecting a time offset between respective portions of the first and second input audio signals corresponding to a given temporal window by:

(i) detecting a set of respective differences between one or more properties of the respective portions, the properties being derived according to each of a group of candidate time offsets under test; and (ii) selecting a time offset for the given temporal window as an offset for which the detecting step (i) detects a set of differences meeting a predetermined criterion;

the processing circuitry being configured, for each of a second plurality of temporal windows, generating (at a step 1905) a portion of the first and second output signals by applying a relative delay between portions of the first and second input audio signals.

Figure 24:
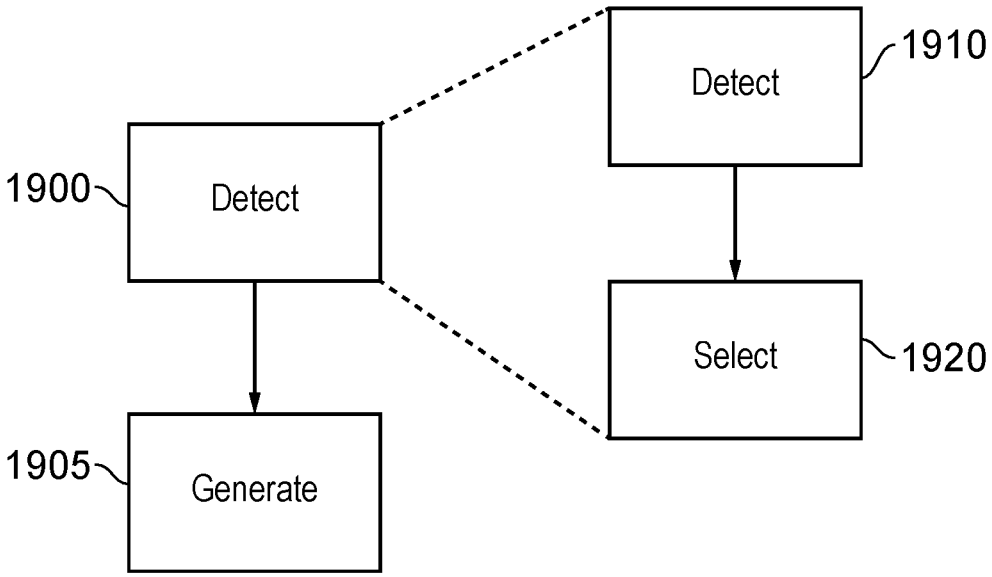
FIGS. 24 and 25 are schematic flowcharts illustrating respective methods.

FIG. 24 is a schematic flowchart illustrating a method of processing each of a plurality of temporal windows of first and second input audio signals to generate first and second output audio signals, the method comprising:

(a) detecting (at a step 1900) a time offset between respective portions of the first and second input audio signals corresponding to a given temporal window by:

(i) detecting (at a step 1910) a correlation between one or more properties of the respective portions according to each of a group of candidate time offsets under test; and (ii) selecting (at a step 1920), as a detected time offset for the given temporal window, an offset for which the detecting step (i) detects a correlation which meets a predetermined criterion; and (b) for each of a second plurality of temporal windows, generating (at a step 1905) a portion of the first and second output signals by applying a relative delay between portions of the first and second input audio signals.

Figure 25:
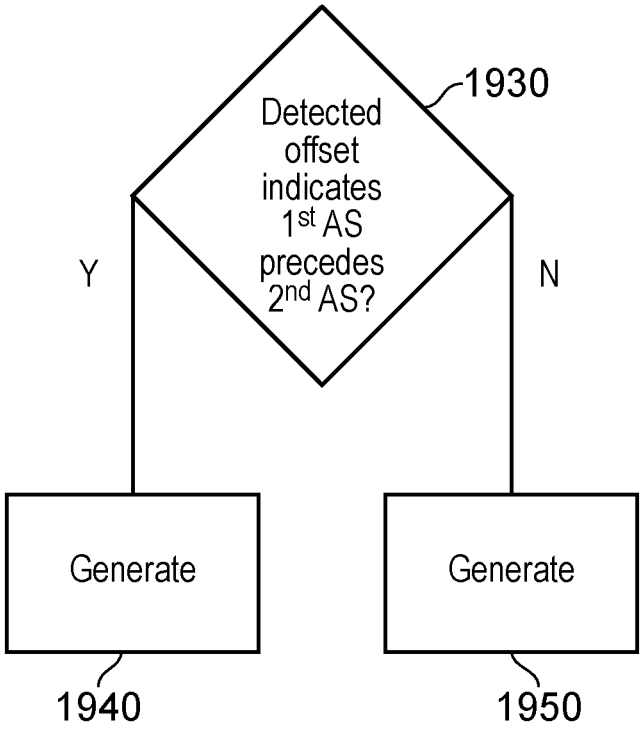

Referring to FIG. 25, the step (b) 1905 may comprise:

for each temporal window, if (at a step 1930) the detected offset for that temporal window indicates that the first input audio signal precedes the second input audio signal:

(iii) generating (at a step 1940) a portion of the first output audio signal by delaying a portion of the first input audio signal for that temporal window by the detected offset for that temporal window and generating a portion of the second output audio signal by reproducing the portion of the second input audio signal for that temporal window;

or otherwise:

(iv) generating (at a step 1950) a portion of the second output audio signal by delaying a portion of the second input audio signal for that temporal window by the detected offset for that temporal window and generating a portion of the first output audio signal by reproducing the portion of the first input audio signal for that temporal window.

In so far as embodiments of the disclosure have been described as being implemented, at least in part, by software-controlled data processing apparatus, it will be appreciated that a non-transitory machine-readable medium carrying such software, such as an optical disk, a magnetic disk, semiconductor memory or the like, is also considered to represent an embodiment of the present disclosure. Similarly, a data signal comprising coded data generated according to the methods discussed above (whether or not embodied on a non-transitory machine-readable medium) is also considered to represent an embodiment of the present disclosure.

It will be apparent that numerous modifications and variations of the present disclosure are possible in light of the above teachings. It is therefore to be understood that within the scope of the appended clauses, the technology may be practised otherwise than as specifically described herein.

Various respective aspects and features will be defined by the following numbered clauses:

1. A method of processing each of a first plurality of temporal windows of first and second input audio signals to generate first and second output audio signals, the method comprising:
   (a) detecting a time offset between respective portions of the first and second input audio signals corresponding to a given temporal window by:
   (i) detecting a correlation between one or more properties of the respective portions according to each of a group of candidate time offsets under test; and
   (ii) selecting, as a detected time offset for the given temporal window, an offset for which the detecting step (i) detects a correlation which meets a predetermined criterion; and
   (b) for each of a second plurality of temporal windows, generating a portion of the first and second output signals by applying a relative delay between portions of the first and second input audio signals.
2. A method according to clause 1, in which the step (b) comprises:
   (b) for each temporal window of the second plurality of temporal windows, if the detected offset for that temporal window indicates that the first input audio signal precedes the second input audio signal:
   (iii) generating a portion of the first output audio signal by delaying a portion of the first input audio signal for that temporal window by the detected offset for that temporal window and generating a portion of the second output audio signal by reproducing the portion of the second input audio signal for that temporal window;
   or otherwise:
   (iv) generating a portion of the second output audio signal by delaying a portion of the second input audio signal for that temporal window by the detected offset for that temporal window and generating a portion of the first output audio signal by reproducing the portion of the first input audio signal for that temporal window.
3. A method according to clause 1 or clause 2, in which the detecting step (i) comprises:
   detecting for the respective portions of the first and second input audio signals, an envelope function in dependence upon signal power in each of a plurality of contiguous sub-windows of the respective portions;
   applying a time offset under test to one of the envelope functions to generate an offset envelope function; and
   detecting a correlation between the offset envelope function and the other of the envelope functions.
4. A method according to any one of clauses 1 to 3, in which the detecting step (i) comprises detecting a correlation between sample values of the respective portions, subject to a relative delay between the respective portions dependent upon a time offset under test.
5. A method according to any one of the preceding clauses, in which a correlation meeting the predetermined criterion is a greatest correlation amongst the correlations detected for each of the group of candidate time offsets under test.
6. A method according to any one of the preceding clauses, in which the selecting step (ii) comprises selecting a zero offset for any temporal window for which the respective portions of the first and second input audio signals have less than a threshold average power.
7. A method according to any one of the preceding clauses, comprising the step, between the steps (a) and (b), of:
   (c) detecting one or more properties of the time offsets detected for the first plurality of temporal windows; and if the time offsets detected for the first plurality of temporal windows meet one or more second predetermined criteria, modifying the group of candidate time offsets under test and repeating the step of detecting a time offset using the modified group of candidate time offsets under test.

8. A method according to clause 7, in which the second predetermined criteria comprise:
   a criterion that more than a threshold proportion of the time offsets selected for the first plurality of temporal windows exhibit a sign change between time offsets selected for adjacent temporal windows; and
   a criterion that a spread of the time offsets selected for the first plurality of temporal windows exceeds a threshold spread; and
   a criterion that at least a threshold proportion of the time offsets selected for the first plurality of temporal windows have a predetermined sign;
   and the step of modifying the group of candidate time offsets under test comprises removing candidate time offsets having one sign.

9. A method according to any one of the preceding clauses, comprising the step, following the step of detecting a time offset, of:
   detecting a distribution of time offsets amongst the time offsets selected for the first plurality of temporal windows; and
   substituting replacement time offset values for any ones of the selected time offsets having at least a threshold difference from a median time offset.

10. A method according to clause 9, in which the step of substituting replacement time offset values comprises:
   for one or more first or last time offsets amongst the time offsets selected for the first plurality of temporal windows, substituting a next-adjacent non-substituted time offset value; and
   for other time offsets amongst the time offsets selected for the first plurality of temporal windows, interpolating a replacement time offset value from surrounding non-substituted time offset values.

11. A method according to clause 2, in which the generating step (iii) comprises:
   in the case of a time gap between the delayed portion and a previously generated portion of the first output audio signal, generating one or more further portions, being one or both of a portion of the first input audio signal following the previously generated portion and a portion of the first input audio signal preceding the delayed portion; and
   cross-fading the delayed portion and any further portion with any temporally overlapping previously generated portion of the first output audio signal;
   and in which the generating step (iv) comprises:
   in the case of a time gap between the delayed portion and a previously generated portion of the second output audio signal, generating one or more further portions, being one or both of a portion of the second input audio signal following the previously generated portion and a portion of the second input audio signal preceding the delayed portion; and
   cross-fading the delayed portion and any further portion with any temporally overlapping previously generated portion of the second output audio signal.

12. A method according to clause 11, comprising the step of:
   selecting a crossfade parameter in dependence upon the correlation between portions to be crossfaded.

13. A method according to any one of the preceding clauses, in which:
   the first and second input audio signals are left and right signals of an input stereo signal; and
   the first and second output audio signals are left and right signals of an output stereo signal.

14. A method according to any one of the preceding clauses, in which:
   the first plurality of temporal windows have a first window size;
   the second plurality of temporal windows have a second window size smaller than the first window size; and
   the step (b) comprises interpolating an offset value associated with each of the second plurality of temporal window from the offsets detected for the first plurality of temporal windows.

15. Computer software comprising program instructions which, when executed by a computer, cause the computer to perform the method of any one of the preceding clauses.

16. A non-transitory machine-readable medium which stores computer software according to clause 15.

17. Audio processing apparatus to process first and second input audio signals to generate first and second output audio signals, the apparatus comprising:
   processing circuitry configured to generate each of a plurality of temporal windows of the first and second output audio signals by:
   detecting a time offset between respective portions of the first and second input audio signals corresponding to a given temporal window by:
   (i) detecting a set of respective differences between one or more properties of the respective portions, the properties being derived according to each of a group of candidate time offsets under test; and
   (ii) selecting a time offset for the given temporal window as an offset for which the detecting step (i) detects a set of differences meeting a predetermined criterion;
   the processing circuitry being configured, for each of a second plurality of temporal windows, to generate a portion of the first and second output signals by applying a relative delay between portions of the first and second input audio signals.

The invention claimed is:

1. A method of processing each of a first plurality of temporal windows of first and second input audio signals to generate first and second output audio signals, the method comprising:
   (a) detecting a time offset between respective portions of the first and second input audio signals corresponding to a given temporal window by:
      (i) detecting a correlation between one or more properties of the respective portions according to each of a group of candidate time offsets under test, wherein detecting the correlation includes:
         detecting for the respective portions of the first and second input audio signals, an envelope function in dependence upon signal power in each of a plurality of contiguous sub-windows of the respective portions,
         applying a time offset under test to one of the envelope functions to generate an offset envelope function, and
         detecting a correlation between the offset envelope function and the other of the envelope functions; and
      (ii) selecting, as a detected time offset for the given temporal window, an offset having a detected correlation which meets a predetermined criterion; and (b) for each of a second plurality of temporal windows, generating a portion of the first and second output audio signals by applying a relative delay between portions of the first and second input audio signals.

2. A method according to claim 1, wherein generating a portion of the first and second output audio signals includes:

(b) for each temporal window of the second plurality of temporal windows, if the detected offset for that temporal window indicates that the first input audio signal precedes the second input audio signal:

(iii) generating a portion of the first output audio signal by delaying a portion of the first input audio signal for that temporal window by the detected offset for that temporal window and generating a portion of the second output audio signal by reproducing the portion of the second input audio signal for that temporal window;

or otherwise:

(iv) generating a portion of the second output audio signal by delaying a portion of the second input audio signal for that temporal window by the detected offset for that temporal window and generating a portion of the first output audio signal by reproducing the portion of the first input audio signal for that temporal window.

3. A method according to claim 1, wherein detecting the correlation includes detecting a correlation between sample values of the respective portions, subject to a relative delay between the respective portions dependent upon a time offset under test.

4. A method according to claim 1, in which a correlation meeting the predetermined criterion is a greatest correlation amongst the correlations detected for each of the group of candidate time offsets under test.

5. A method according to claim 1, wherein selecting includes selecting a zero offset for any temporal window for which the respective portions of the first and second input audio signals have less than a threshold average power.

6. A method according to claim 1, further comprising, between (a) and (b):

(c) detecting one or more properties of the time offsets detected for the first plurality of temporal windows; and if the time offsets detected for the first plurality of temporal windows meet one or more second predetermined criteria, modifying the group of candidate time offsets under test and repeating detecting a time offset using the modified group of candidate time offsets under test.

7. A method according to claim 6, in which the second predetermined criteria comprise:

a criterion that more than a threshold proportion of the time offsets selected for the first plurality of temporal windows exhibit a sign change between time offsets selected for adjacent temporal windows; and a criterion that a spread of the time offsets selected for the first plurality of temporal windows exceeds a threshold spread; and a criterion that at least a threshold proportion of the time offsets selected for the first plurality of temporal windows have a predetermined sign; and modifying the group of candidate time offsets under test includes removing candidate time offsets having one sign.

8. A method according to claim 1, further comprising, following detecting a time offset:

detecting a distribution of time offsets amongst the time offsets selected for the first plurality of temporal windows; and substituting replacement time offset values for any ones of the selected time offsets having at least a threshold difference from a median time offset.

9. A method according to claim 8, wherein substituting replacement time offset values includes:

for one or more first or last time offsets amongst the time offsets selected for the first plurality of temporal windows, substituting a next-adjacent non-substituted time offset value; and for other time offsets amongst the time offsets selected for the first plurality of temporal windows, interpolating a replacement time offset value from surrounding non-substituted time offset values.

10. A method according to claim 2, wherein generating the portion of the first output audio signal includes:

in the case of a time gap between the delayed portion and a previously generated portion of the first output audio signal, generating one or more further portions, being one or both of a portion of the first input audio signal following the previously generated portion and a portion of the first input audio signal preceding the delayed portion; and cross-fading the delayed portion and any further portion with any temporally overlapping previously generated portion of the first output audio signal;

and wherein generating the portion of the second output audio signal includes:

in the case of a time gap between the delayed portion and a previously generated portion of the second output audio signal, generating one or more further portions, being one or both of a portion of the second input audio signal following the previously generated portion and a portion of the second input audio signal preceding the delayed portion; and cross-fading the delayed portion and any further portion with any temporally overlapping previously generated portion of the second output audio signal.

11. A method according to claim 10, further comprising:

selecting a crossfade parameter in dependence upon the correlation between portions to be crossfaded.

12. A method according to claim 1, in which:

the first and second input audio signals are left and right signals of an input stereo signal; and the first and second output audio signals are left and right signals of an output stereo signal.

13. A method according to claim 1, in which:

the first plurality of temporal windows have a first window size;

the second plurality of temporal windows have a second window size smaller than the first window size; and wherein generating the portion of the first and second output audio signals includes interpolating an offset value associated with each of the second plurality of temporal window from the offsets detected for the first plurality of temporal windows.

14. Computer software comprising program instructions which, when executed by a computer, cause the computer to perform the method of claim 1.

15. A non-transitory machine-readable medium which stores computer software according to claim 14.

16. Audio processing apparatus to process first and second input audio signals to generate first and second output audio signals, the apparatus comprising:

processing circuitry configured to generate each of a plurality of temporal windows of the first and second output audio signals by:

detecting a time offset between respective portions of the first and second input audio signals corresponding to a given temporal window by:

(i) detecting a set of respective differences between one or more properties of the respective portions, the properties being derived according to each of a group of candidate time offsets under test; and (ii) selecting a time offset for the given temporal window as an offset having a detected set of differences meeting a predetermined criterion;

the processing circuitry being configured, for each of a second plurality of temporal windows, to generate a portion of the first and second output audio signals by applying a relative delay between portions of the first and second input audio signals, wherein:

a first plurality of temporal windows have a first window size;

the second plurality of temporal windows have a second window size smaller than the first window size; and the processing circuitry being configured to interpolate an offset value associated with each of the second plurality of temporal window from the offsets detected for the first plurality of temporal windows.

17. A method of processing each of a first plurality of temporal windows of first and second input audio signals to generate first and second output audio signals, the method comprising:

(a) detecting a time offset between respective portions of the first and second input audio signals corresponding to a given temporal window by:

(i) detecting a correlation between one or more properties of the respective portions according to each of a group of candidate time offsets under test; and (ii) selecting, as a detected time offset for the given temporal window, an offset for which the detecting (i) detects a correlation which meets a predetermined criterion and selecting a zero offset for any temporal window for which the respective portions of the first and second input audio signals have less than a threshold average power; and (b) for each of a second plurality of temporal windows, generating a portion of the first and second output signals by applying a relative delay between portions of the first and second input audio signals.

18. A method of processing each of a first plurality of temporal windows of first and second input audio signals to generate first and second output audio signals, the method comprising:

(a) detecting a time offset between respective portions of the first and second input audio signals corresponding to a given temporal window by:

(i) detecting a correlation between one or more properties of the respective portions according to each of a group of candidate time offsets under test, and (ii) selecting, as a detected time offset for the given temporal window, an offset for which detecting (i) detects a correlation which meets a predetermined criterion;

(b) detecting one or more properties of the time offsets detected for the first plurality of temporal windows; and if the time offsets detected for the first plurality of temporal windows meet one or more second predetermined criteria, modifying the group of candidate time offsets under test and repeating detecting of a time offset using the modified group of candidate time offsets under test; and (c) for each of a second plurality of temporal windows, generating a portion of the first and second output signals by applying a relative delay between portions of the first and second input audio signals.

19. A method of processing each of a first plurality of temporal windows of first and second input audio signals to generate first and second output audio signals, the method comprising:

(a) detecting a time offset between respective portions of the first and second input audio signals corresponding to a given temporal window by:

(i) detecting a correlation between one or more properties of the respective portions according to each of a group of candidate time offsets under test; and (ii) selecting, as a detected time offset for the given temporal window, an offset for which detecting (i) detects a correlation which meets a predetermined criterion;

detecting a distribution of time offsets amongst the time offsets selected for the first plurality of temporal windows;

substituting replacement time offset values for any ones of the selected time offsets having at least a threshold difference from a median time offset; and (b) for each of a second plurality of temporal windows, generating a portion of the first and second output signals by applying a relative delay between portions of the first and second input audio signals.

20. A method of processing each of a first plurality of temporal windows of first and second input audio signals to generate first and second output audio signals, the method comprising:

(a) detecting a time offset between respective portions of the first and second input audio signals corresponding to a given temporal window by:

(i) detecting a correlation between one or more properties of the respective portions according to each of a group of candidate time offsets under test; and (ii) selecting, as a detected time offset for the given temporal window, an offset for which detecting (i) detects a correlation which meets a predetermined criterion; and (b) for each of a second plurality of temporal windows, generating a portion of the first and second output signals by applying a relative delay between portions of the first and second input audio signals, for each temporal window of the second plurality of temporal windows, if the detected offset for that temporal window indicates that the first input audio signal precedes the second input audio signal:

(iii) generating a portion of the first output audio signal by delaying a portion of the first input audio signal for that temporal window by the detected offset for that temporal window and generating a portion of the second output audio signal by reproducing the portion of the second input audio signal for that temporal window, in the case of a time gap between the delayed portion and a previously generated portion of the first output audio signal, generating one or more further portions, being one or both of a portion of the first input audio signal following the previously generated portion and a portion of the first input audio signal preceding the delayed portion, and cross-fading the delayed portion and any further portion with any temporally overlapping previously generated portion of the first output audio signal;

or otherwise:

(iv) generating a portion of the second output audio signal by delaying a portion of the second input audio signal for that temporal window by the detected offset for that temporal window and generating a portion of the first output audio signal by reproducing the portion of the first input audio signal for that temporal window, in the case of a time gap between the delayed portion and a previously generated portion of the second output audio signal, generating one or more further portions, being one or both of a portion of the second input audio signal following the previously generated portion and a portion of the second input audio signal preceding the delayed portion, and cross-fading the delayed portion and any further portion with any temporally overlapping previously generated portion of the second output audio signal.

21. A method of processing each of a first plurality of temporal windows of first and second input audio signals to generate first and second output audio signals, the method comprising:

(a) detecting a time offset between respective portions of the first and second input audio signals corresponding to a given temporal window by:

(i) detecting a correlation between one or more properties of the respective portions according to each of a group of candidate time offsets under test; and (ii) selecting, as a detected time offset for the given temporal window, an offset having a detected correlation which meets a predetermined criterion; and (b) for each of a second plurality of temporal windows, generating a portion of the first and second output audio signals by applying a relative delay between portions of the first and second input audio signals, wherein:

the first plurality of temporal windows have a first window size;

the second plurality of temporal windows have a second window size smaller than the first window size; and generating the portion of the first and second output audio signals includes interpolating an offset value associated with each of the second plurality of temporal window from the offsets detected for the first plurality of temporal windows.

* * * * *